US007130380B2

(12) United States Patent
Lovoi et al.

(10) Patent No.: US 7,130,380 B2
(45) Date of Patent: Oct. 31, 2006

(54) EXTRACTOR CUP ON A MINIATURE X-RAY TUBE

(75) Inventors: Paul A. Lovoi, Saratoga, CA (US); Petre H. Vatahov, San Jose, CA (US); Earl E. Dozier, Livermore, CA (US); Peter C. Smith, Half Moon Bay, CA (US); Leonard Reed, Woodside, CA (US); Robert G. Neimeyer, San Jose, CA (US)

(73) Assignee: Xoft, Inc., Fremont, CA (US)

( * ) Notice: Subject to any disclaimer, the term of this patent is extended or adjusted under 35 U.S.C. 154(b) by 188 days.

(21) Appl. No.: 10/799,450

(22) Filed: Mar. 13, 2004

(65) Prior Publication Data

US 2006/0177001 A1 Aug. 10, 2006

(51) Int. Cl.
*H01J 35/32* (2006.01)

(52) U.S. Cl. ..... 378/121; 378/136; 313/238; 313/271

(58) Field of Classification Search ..... 378/119, 378/121, 136; 313/238, 239, 240, 242, 271, 313/276

See application file for complete search history.

(56) References Cited

U.S. PATENT DOCUMENTS 5,621,780 A * 4/1997 Smith et al. ..... 378/65
5,854,822 A * 12/1998 Chornenky et al. ..... 378/122
6,319,188 B1 * 11/2001 Lovoi ..... 600/3
6,987,835 B1 * 1/2006 Lovoi ..... 378/136

* cited by examiner

*Primary Examiner*—Courtney Thomas
(74) *Attorney, Agent, or Firm*—Thomas M. Freiburger

(57) ABSTRACT

Methods for connecting electrical potential to an extractor cup at the cathode of a miniature x-ray tube are disclosed. The various connection schemes are designed to form a rugged and conveniently manufacturable connection between the metal extractor cup and one side of the cathode filament, so that the extractor cup shapes the path of electrons as desired en route to the anode of the tube. Some of the disclosed connections involve evaporation of conductive metal or other materials off the filament when the filament is first activated. Others involve applying a paste or paint conductive precursor directly to a base to connect a post and the extractor, the paste being heat-cured after the completion of assembly. Others involve a fine wire or spring strip from one filament post to the walls of the extractor cup. Other schemes include welded or brazed wires or foil, crimping, pinching, swaging and other connections, all made inside the tube enclosure.

11 Claims, 7 Drawing Sheets

FIG. 1
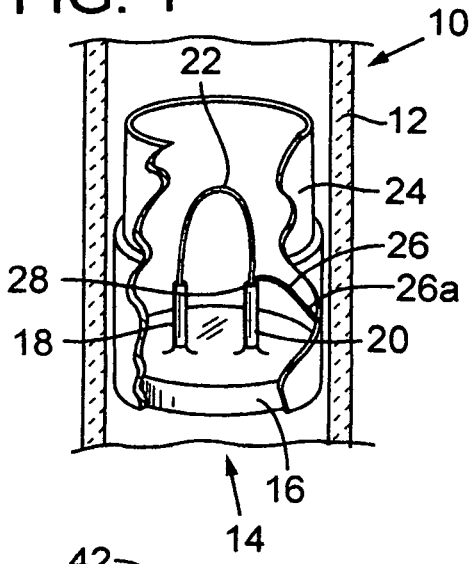
FIG. 2
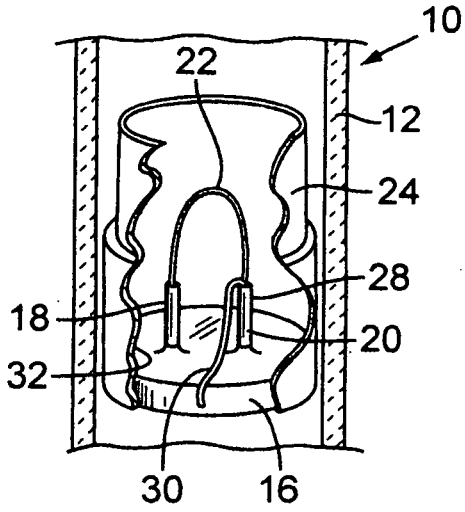
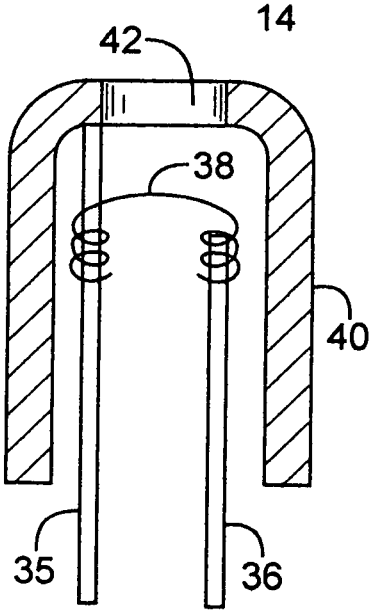
FIG. 3
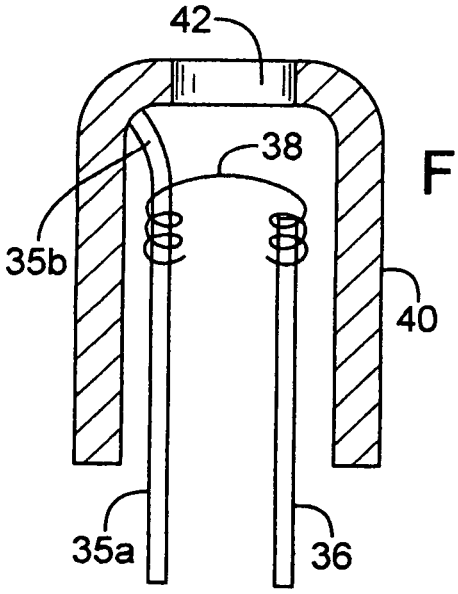
FIG. 4

FIG. 20
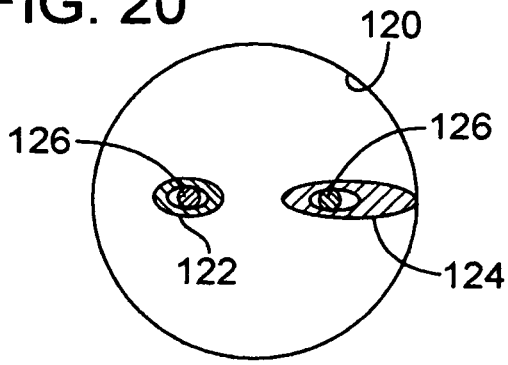
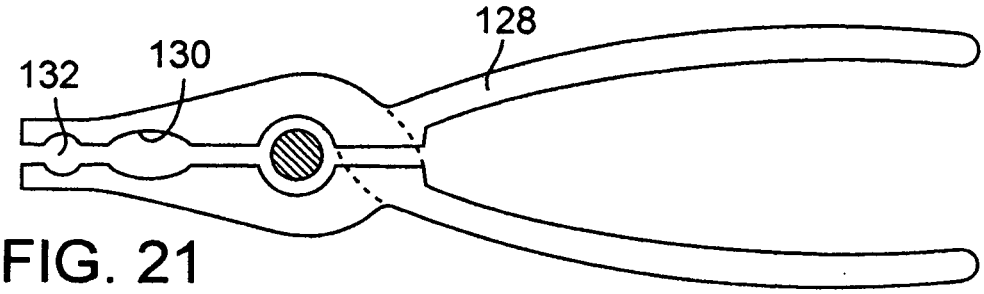
FIG. 21
FIG. 22
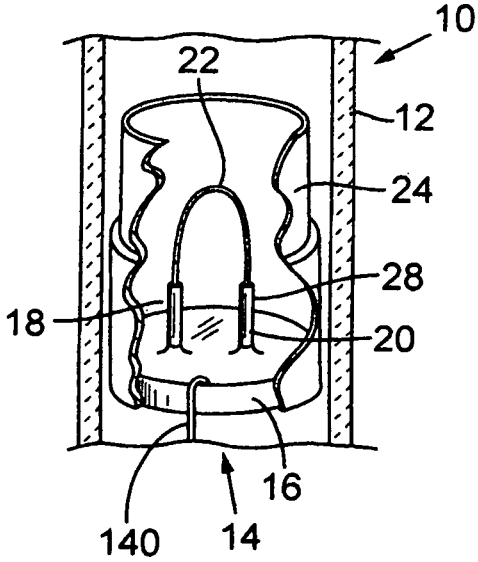

EXTRACTOR CUP ON A MINIATURE X-RAY TUBE

BACKGROUND OF THE INVENTION

This invention concerns construction of miniature x-ray tubes. In particular the invention is directed at an efficient and rugged connection of a high voltage cathode filament lead to an extractor cup which helps shape the path of electrons from the cathode in such an x-ray tube.

Miniature x-ray tubes, generally of the size and configuration contemplated in this invention, are shown in Xoft Microtube U.S. Pat. No. 6,319,188, and also in U.S. Pat. Nos. 5,854,822 and 5,621,780. Also, Xoft Microtube pending application Ser. No. 10/397,498 describes a cathode assembly with a cathode manufactured by MEMS technology and discloses a means of forming an extractor cup and electrically connecting the extractor cup to high voltage.

As is known, an extractor cup is usually needed to help focus and direct the stream of electrons leaving a cathode en route to the anode in an x-ray tube, and the need for focusing this electron beam typically becomes more acute in the case of miniature x-ray tubes. However, the connection of an extractor cup to high voltage, in a rugged, reliable and feasibly manufacturable manner, presents something of a challenge. There are problems of reliably connecting a conductor to one end of a cathode filament or a wire lead to the cathode; it is not feasible simply to extend a conductor wire through the tube wall to the exterior, because of sealing problems and because of the requirement to isolate this HV from the tube exterior which is at ground potential; and in miniature size, which may be down to about 1 mm in tube diameter, the options are limited in making secure high voltage connections in proper alignment, to withstand high temperature, without causing the tube to fail ultimately through arcing and while still obtaining a rugged and reliable connection of the extractor cup to a base of the cathode and secure connection of the cathode itself to the base.

SUMMARY OF THE INVENTION

The invention encompasses various means for making secure and rugged connections of an extractor cup to high voltage at the cathode of a miniature x-ray tube.

The various connection schemes are designed to form a rugged and conveniently manufacturable connection between the metal extractor cup and one side of the cathode filament, so that the extractor cup shapes the path of electrons as desired en route to the anode of the tube. Some connections of the invention involve evaporation of conductive metal or other materials off the filament when the filament is first activated. Some involve direct liquid application of conductive metal as a paste or paint. Others involve a fine wire or spring strip from one filament post to the walls of the extractor cup, or a direct contact of one filament post with the extractor wall. Other schemes include welded or brazed wires or foil, crimping, pinching, swaging and other connections, including shifting of a conductive member after initial assembly, all made inside the tube enclosure.

In one preferred embodiment of the invention, a miniature x-ray tube has an extractor cup generally surrounding a cathode filament, the two ends of the cathode filament being connected in a low voltage cathode heater circuit, and the filament being at high voltage opposing the anode of the tube. The cathode filament is supported on posts from a cathode base, at least one of the posts being conductive. The filament is pre-coated with a conductive metal such as gold which will flash off or evaporate from the filament when the filament is initially energized in the heater circuit and heated. When the cathode filament is heated, the conductive metal is coated onto all adjacent surfaces, including the base. A small shield or shadowing device is mounted on one of the filament posts to shadow an area of the base adjacent to the one post from receiving the coating. This forms an electrical connection between the other filament post and the base surface, and between the base surface and the wall of the extractor cup, thereby connecting high voltage to the extractor cup. The one filament post referenced above remains insulated from the other post, so as not to create a short in the low voltage heater circuit.

In a variation of the above, the cathode filament is pre-coated with a semiconductor material that will flash off or evaporate when heated. The shield is not included on either post, and the semiconductor material is evaporated onto the base along both posts and onto the extractor cup. The semiconductor material has a sufficiently high resistance as not to interfere with the low voltage circuit of the cathode filament so that current flow to heat the cathode is largely unaffected. This method also has the advantage of draining extraneous charge buildup from the extractor cup due to electrons striking the extractor.

In other preferred embodiments a spring strip, wire, conductive whisker or conductive foil is placed inside the tube to connect one of the cathode filament posts to a conductive surface of the extractor. In one scheme a spring strip or springy sheet of foil or whisker is spot welded onto one of the filament posts, extending to the walls of the extractor cup to from a connection which will be robust even during thermal expansion. In another scheme a foil sheet is placed against a glass preform which comprises the base of the cathode assembly, engaging around or against one of the filament posts and also against a wall of the extractor. A braze alloy that melts below about 900° C. may be used, for the case where glassing temperature is about 950° C. During the thermal cycle for the glass preform, the braze material will melt and create an electrical bath between the one filament post and the extractor.

In other connection methods a wire or whisker is crimped together with the cathode filament at one end, into the filament post, and this wire extends into contact with the conductive surface of the extractor cup. This can be done with a braze alloy on the end of the wire and with the wire contacting the internal diameter of the extractor cup. The temperature to which the tube is raised during assembly will equal or exceed the melting temperature of the braze alloy to provide a permanent bond of the wire or whisker with the extractor wall. In another arrangement the end of the wire that extends from the filament post hangs over the edge of the insulating base on which the posts are mounted, and when the extractor ring is assembled down onto the insulating base, the end of the wire is pinched between the edge of the preform and the wall of the extractor cup, deforming and swaging the wire to form a good connection. For this purpose the wire is advantageously formed of platinum or other soft metal. The connection is made permanent when the preform is heated.

In another type of connection the filament of the cathode extends between a single post and the wall of the extractor cup, with that wall being connected to another lead at the base of the extractor, so that the extractor serves as part of one filament lead. A further scheme has two filament posts, one being longer and placed so as to make contact with a top edge of the extractor cup, near its opening, on assembly of the extractor to the base. In another method a cathode assembly has two posts or pins supporting the cathode filament, and the filament is secured to these pins or posts such that after being crimped to one of the posts, the filament extends beyond that post and makes contact with the extractor wall.

In a different embodiment, the cathode filament is supported between coaxial conductors which extend up into the extractor cup. The external coaxial conductor is conductive, and in one type of connection the extractor cup, all of conductive material, has a bottom or base with a hole which on assembly slides down over the outer coaxial conductor and makes electrical contact. Other connection schemes involving the coaxial filament leads include a conductive metal strip extending radially from the outer coaxial conductor to the extractor wall; use of wires or spring wires which contact the exterior coaxial conductor and extend to the extractor wall; and the use of spring clips that engage between the outer coaxial conductor lead and the extractor wall.

It is therefore among the objects of the invention to provide rugged and reliable high voltage connections from a cathode filament to a surrounding extractor cup, in a manner that can be reliably manufactured in a miniature x-ray tube. These and other objects, advantages, and features of the invention will be apparent from the following description of preferred embodiments, considered along with the drawings.

DESCRIPTION OF THE DRAWINGS

FIG. 1 is a schematic view in perspective and partially cut away, showing a portion of a x-ray tube with a cathode and an extractor cup and showing a means of connecting high voltage to the extractor involving use of a wire connected to the cathode filament.

FIG. 2 is a view similar to FIG. 1, showing a different connection arrangement involving a filament-connected wire.

FIGS. 3 and 4 are simplified schematic views showing further embodiments of cathode/extractor connections, in this case involving a filament support post directly contacting the extractor cup.

FIGS. 20 and 21 relate to another scheme for making the electrical contact, in this case with an elongated crimp of the cathode filament supporting posts, with FIG. 21 showing a tool for such a crimping operation.

FIG. 22 is a view similar to FIG. 1, but showing a variation wherein a third HV wire connects to the extractor, permitting a bias to be introduced.

DESCRIPTION OF PREFERRED EMBODIMENTS

Figure 5:
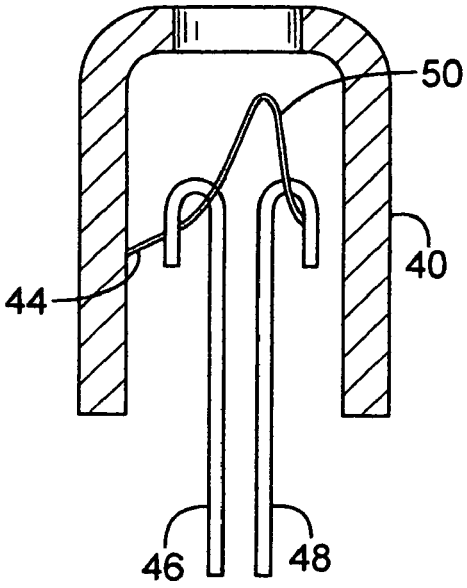
FIG. 5 is a simplified schematic view showing a cathode filament with a tail end directly contacting an extractor cup wall.

FIG. 1 shows a portion of a miniature x-ray tube 10, including a tube envelope 12 and a cathode assembly 14. Within the cathode assembly are a base 16, typically a glass preform, a pair of cathode filament supports posts or pins 18 and 20, a cathode filament 22, and an extractor cup 24. The filament support posts or pins 18 and 20 preferably extend up through openings in the base 16, being connected below the base to conductors which run through a flexible cable which may be part of a catheter. These posts, and the cathode filament 22, are in a low voltage cathode heater circuit, and high voltage potential is also supplied to the entire cathode so that electrons from the cathode will flow toward the anode (not shown) at the other end of the x-ray tube 10. Thus the two cathode posts or pins 18 and 20 are both at high potential, but different by the small amount of the low voltage circuit.

The extractor cup 24 should be at similar high voltage potential to the cathode filament 22, its purpose being to repel electrons so as to shape the stream of electrons flowing toward the anode, something like a lens acting on light. FIG. 1 shows one arrangement for connecting the preferably metal extractor cup 24 to the high potential of one side of the filament 22. In this case a "whisker" of wire 26, which may be Kovar, is attached to one of end of the filament within the post 20, which may be accomplished by crimping the tubular post end 28 over both the filament end and the wire 26 end.

The whisker of wire 26 in a preferred embodiment has a small amount of braze alloy at its outer end 26*a*, and this outer end contacts the extractor cup's inner wall. The braze alloy may be attached to the wire by resistance welding, mechanical attachment or pre-melting. Its purpose is to secure the end 26*a* of the wire permanently to the inner wall of the extractor cup 24. Thus, the temperature encountered during assembly of the tube 10 must equal or exceed the melting temperature of the alloy in order to provide the desired bond. The alloy melting temperature must be above the temperatures encountered during operation of the x-ray tube 10.

The advantage of this connection method is in establishing a very robust electrical connection that will not fail during device operation.

In a variation of the above connection method, the braze alloy is omitted. The wire 26 is springy and remains springy under operation temperature, maintaining firm contact with the inner extractor wall under all temperatures encountered.

FIG. 2 shows another variation of the filament-attached wire scheme shown in FIG. 1. In this form of connection, a wire 30, preferably of platinum or other soft conductive metal, is again co-crimped together with the cathode filament 22 at the upper end 28 of one filament support post 20, which may be of the material Kovar. In a preferred embodiment the wire 30 has a diameter of about 0.002 inch. The other end of the soft wire 30 is laid down over the edge of the glass preform base 16 as shown in FIG. 2. The extractor cup 24 has a bore or rim 32 which is just slightly larger than the glass preform 16 at the bottom, and when the extractor cup is pressed down over this glass preform, a firm electrical connection is made with the interior metal or metalized surface of the extractor cup. This assembly pinches and swages the soft wire 30.

When the glass preform is heated and partially melted, this locks the extractor 24 in place and assures a continued electrical connection.

To prevent severing of the wire 30, the glass preform needs a soft edge, which can be achieved by grinding. The relative diameters of the extractor bore 32 and the preform base 16 are also important, since there must be some gap space to prevent pinching off the wire. Although platinum wire is preferred, other metals such as gold could also be used. If the wire has excess length, it is trimmed off the bottom of the extractor cup after assembly of the extractor cup.

FIGS. 3 and 4 show another arrangement for connecting high voltage to an extractor cup in the cathode of an x-ray tube. In FIG. 3 a pair of filament support posts 35 and 36 support a filament 38, surrounded by an extractor cup 40. The two legs of the filament 38 may be wound around the conductive support posts or pins 35 and 36, as generally and schematically shown in FIG. 3, and firmly secured thereto. One post 35 is longer than the other post 36, and may be placed wider from center, but in any event is placed wider than the opening 42 of the extractor cup, as shown. On assembly, the extractor cup is placed over the cathode filament such that the longer post 35 engages against the top inner surface of the extractor cup 40, as shown, making electrical contact. Another advantage of this type of assembly and connection is that the filament position relative to the top of the extractor cup and the opening 42 is closely controlled by the length of the post 35.

FIG. 4 shows a variation of the above, wherein the one filament support post 35*a* need not be set widely, the post being curved outwardly at its upper end 35*b*, where contact is made with the interior of the extractor cup 40.

In FIG. 5 another embodiment uses another direct method of connection to connect high voltage from the cathode to the extractor cup. In this case the direct connection comprises a pigtail 44 extending from the filament beyond one of the filament support posts 46. The support posts or pins 46 and 48 are preferably crimped over the filament 50 generally as shown, with an extending tail 44 directly in contact with the wall of the extractor cup 40. The filament pigtail 44 may be connected to the wall by a braze alloy, with the connection made in the embodiment of FIG. 1, or the filament pigtail may simply act as springy wire which maintains contact with the extractor including during the high temperature operation of the tube.

Figure 6:
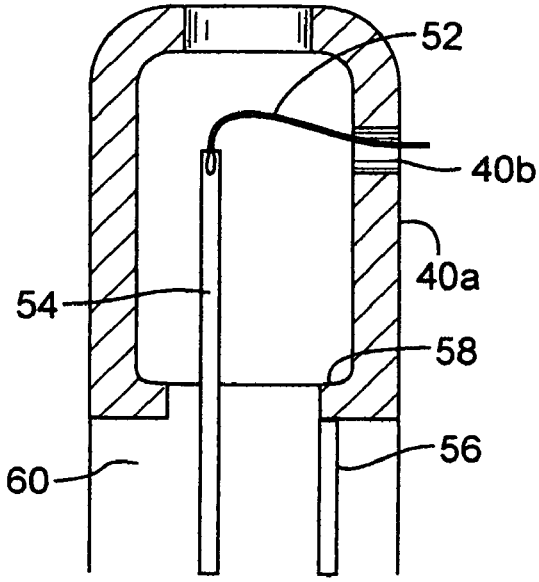
FIG. 6 is a simplified schematic view showing a cathode filament supported between a single pin or post and the wall of an extractor cup.

FIG. 6 shows another variation for direct connection with the extractor cup 40*a*. The filament 52 in this arrangement is secured to only a single filament support post or pin 54, and extends to the extractor cup 40*a*, where it is permanently secured and where the filament is supported. The extractor cup may have a side slot or hole 40*b* for receiving the end or leg of the filament 52. The side hole or slot 40*b* can be filled with a conductive material that cures upon firing. Alternatively, the end of the filament 52 could be brazed to the extractor wall (without a slot) or it could be coated with a braze alloy and permanently secured to the wall upon heating, as in the embodiment of FIG. 1. In this form of connection, the extractor cup serves as one lead of the filament power source, and it is connected to a lead 56 extending up from the base of the cathode assembly and from the catheter (not shown), then connected by a conductor 58 to the wall of the extractor cup 40*a*. If the lead 56 reaches the surface of the base 60, which may in some embodiments comprise a seal material, then the electrical connection 58 can comprise the material that seals the extractor cup to the base. The lead 56 may extend to a position to be bonded directly to the extractor cup, or it may be forced into contact with the side of the extractor when the extractor is assembled onto the base 60. This arrangement is useful for smaller tube diameters, in that only a single power post is needed inside the extractor. It is also useful if coaxial conductors are used as leads to the filament, generally as shown in FIGS. 11–14, but with only the center conductor extending up into the extractor and a filament between the center conductor and the wall.

Figure 7:
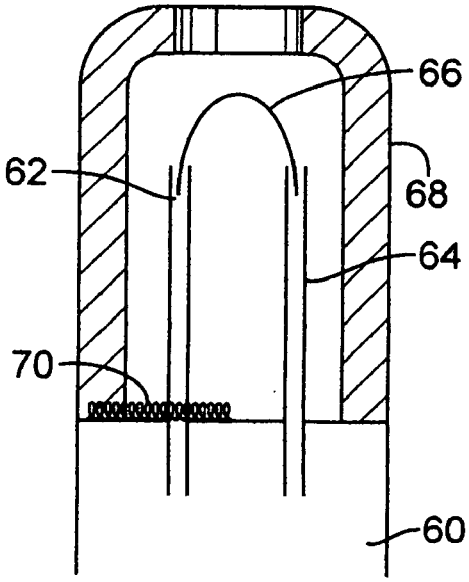
FIG. 7 is a simplified schematic view showing another connection arrangement in which a metal film, i.e. a paint or paste, is applied as a connecting conductor and later heat-cured.

FIG. 7 shows another arrangement for connecting an extractor cup to high voltage. In this assembly the seal 60, which may comprise a glass preform as in previous embodiments, supports a pair of filament posts or pins 62 and 64. The cathode filament is shown at 66, crimped or otherwise retained to the top ends of the posts or pins 62, 64. An extractor cup 68 surrounds the filament and posts, and the extractor is assembled against or over the edge of the glass preform base 60. In this case the filament lead or post 62 is connected to the extractor by use of a vacuum stable conductive metallic paste or paint 70. FIG. 7 shows this conductive metal film 70 extending around and in contact with the bottom end of the post or pin 62 and also contacting the extractor cup 68. The material 70 is a precursor cured by thermal processing to form the conductive metallic connector. For this purpose, reduced nickel oxide and organometallic gold inks were used successfully. This precursor material is applied by painting it in the area as shown, followed by thermal processing. Application can be with a brush, a paint preform (plastic tape with metallizing powder embedded), or with a needle applicator.

Figure 8:
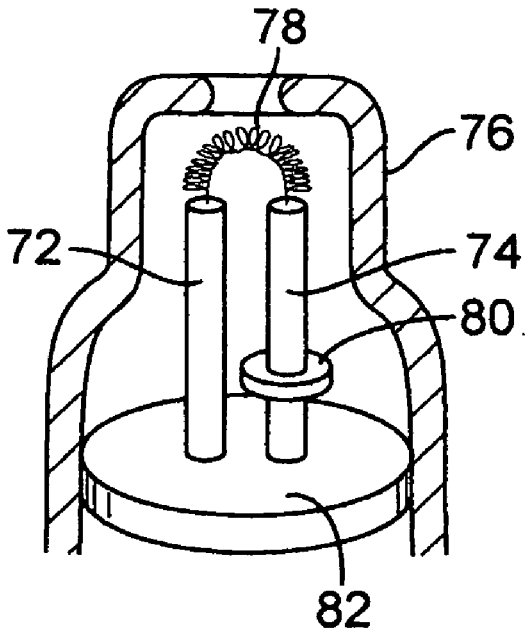
FIG. 8 is a schematic view in perspective showing a connection technique involving conductive metal evaporated from the cathode filament onto a base surface to make the needed connection with a portion of the base shadowed by a shield.

FIG. 8 illustrates a connection method in which conductive metal is evaporated onto surfaces to connect one of the filament supporting posts or pins 72, 74 to the extractor cup 76. The filament 78 of the cathode is coated with a conductive material that will evaporate off and be deposited onto adjacent surfaces when the filament is heated. Gold is one preferred material. In this case a shield 80 is connected to the filament post 74 which is not to be connected to the extractor.

When the assembly has been made and the tube evacuated, the filament coating is evaporated off, as in a vacuum evaporation process. The filament is powered to raise it to a prescribed temperature, and this causes the gold to flash off the filament and to be deposited on the inside of the extractor cup and onto the base 82 and against the one filament support post or lead 72. This forms a high-integrity connection between the base of the conductive post or pin lead 72 and the wall of the extractor cup. In addition, the inside of the extractor cup is coated with the conductive material, and if it is gold, this will reflect infrared radiation very well, thereby lowering the heat loss to the wall of the extractor cup and reducing power required to operate the filament 78 at a given temperature.

Figure 9:
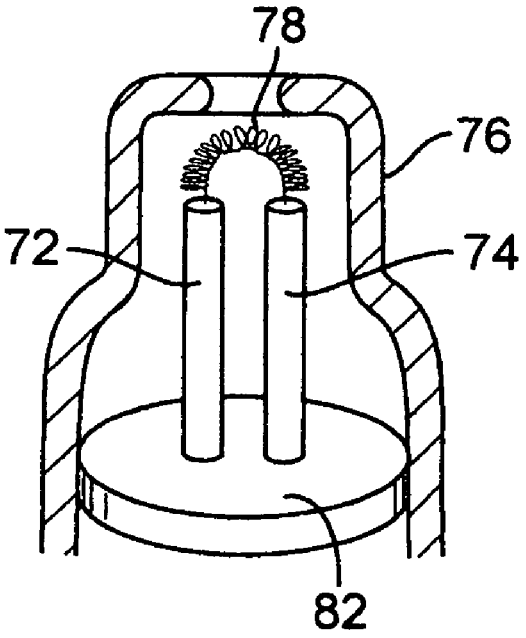
FIG. 9 is a view similar to FIG. 8, but showing use of a different evaporative material, without any shield.

FIG. 9 shows a variation of the above. This connection scheme is very similar to that of FIG. 8, but without the shield 80 to shadow an area of the base 82. In this method the filament is coated with an evaporating semiconductor, so that the coating connects both the filament posts or pins 72, 74 to the extractor cup 76 via deposit on the base surface 82. If the coating is in the thousands of ohms resistance, then the power loss in the coating will be very low, and the extractor cup will still remain at filament potential. The resistance can be about 200,000 to 300,000 ohms, up to about 1 megaohm. The resistive nature of the connection will also aid in reducing arcing and damage due to arcs, and will tend to drain off excess charge built up on the extractor. The excess charge builds up due to being struck by free electrons. This develops a voltage which will tend to flow to lower potential via available conductors. How fast the charge builds up, the maximum allowable voltage difference and the rate the charge is drained off determine if the connection is sufficient to do the job. Cutoff is a couple of volts above the filament voltage. The charge delivered will develop a voltage based on the capacitance of the extractor and the rate of drain.

Figure 10:
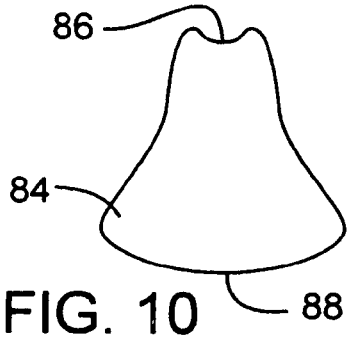
FIG. 10 is a schematic view showing a flat piece of conductive foil which can be used to connect a filament post to an extractor wall, the foil being cured by heating.

FIG. 10 shows in a plan view or flat view a connector 84 that may be placed in the cathode assembly to make the connection between a filament support pin and the extractor wall (pin and wall not shown). The connector element may be used above or below a glass preform base such as shown in previous embodiments. A braze preform wire can be placed around or against one of the filament pins or posts and, during the thermal cycle to flow the glass preform, the braze material will melt and create an electrical path between that filament post and the extractor. A braze alloy that melts below 900° C. preferably is selected, as glassing temperature typically is about 950° C. Instead of a wire, the preform can be shaped from braze foil as in the shape 84 shown in FIG. 10. Such a braze foil might be about 0.002 to 0.003 inch thick, and it can be chemically machined into a shape such as shown in FIG. 10, to match the geometry of a cathode assembly so as to conform closely to a filament post or pin at a small-radius end 86 and to conform to the wall of the extractor cup at a larger-radius end 88.

Figure 11:
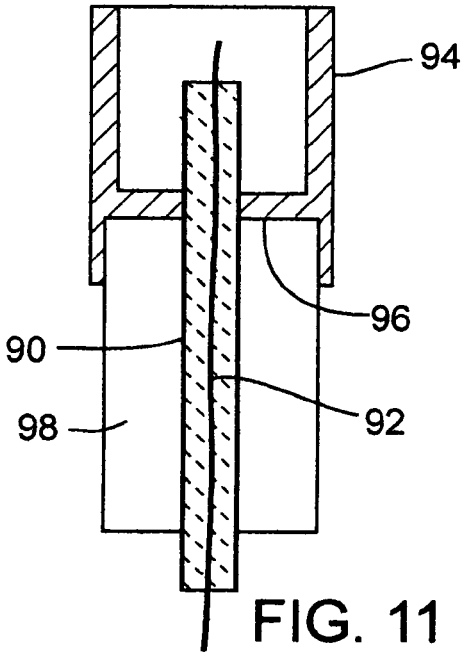
FIG. 11 is a schematic sectional view showing one connection scheme wherein the cathode filament leads are coaxial conductors.
Figure 11A:
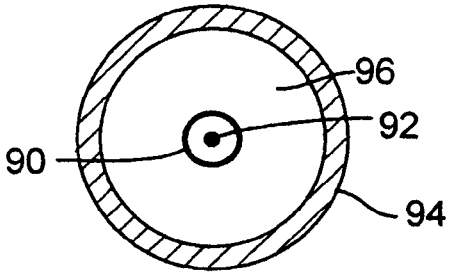
FIG. 11A is a sectional view of the arrangement shown in FIG. 11.

FIGS. 11–14 show further means of connecting a filament lead to the wall of an extractor cup, in an assembly using a coaxial pair of filament leads. FIG. 11 shows a first example of such a construction. The coaxial pair of leads is shown with the outside conductor at 90 and the inside conductor at 92, extending upwardly as a single post into an extractor cup 94. In this embodiment the extractor cup includes a conductive bottom plate 96 with a central hole which slides down over the coaxial cable leads and will make electrical connection with the outside conductor 90 if the hole has the proper dimension. Brazing can be applied but is generally not necessary. The coaxial cable is shown extending up through a ceramic spool 98. FIG. 11A shows a plan view cross-section of the FIG. 11 assembly. Note that the inside conductor can extend up and loop over to make contact with one side of the outside conductor to serve as the cathode filament (detail not shown). In this case the filament will be somewhat off-center, and this can be compensated by eccentric positivity of the coaxial cable in the extractor.

Figure 12:
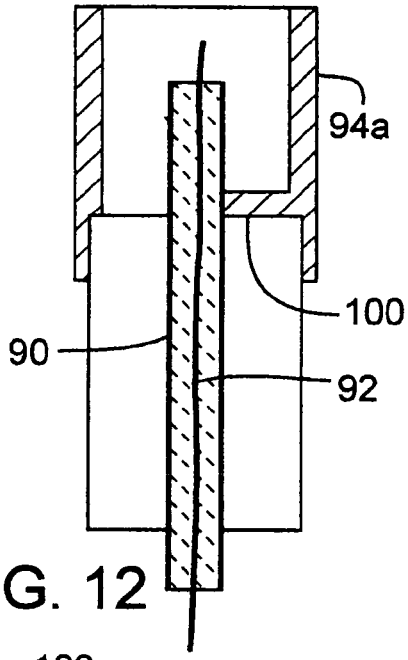
FIG. 12 is a view similar to FIG. 11, but showing a different means of connection.
Figure 12A:
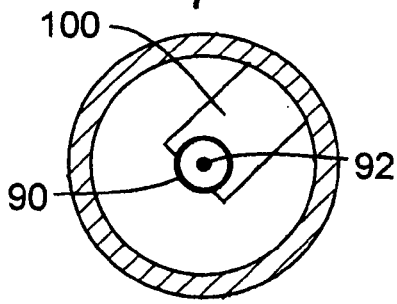
FIGS. 12A and 12B are schematic sectional views of the arrangement shown in FIG. 12, and of a variation.
Figure 12B:
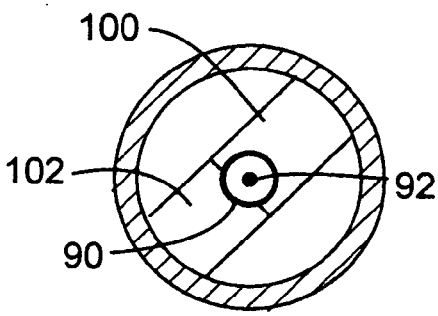

FIGS. 12 12A and 12B show variations wherein a conductive element is added to connect the coaxial leads 90, 92 with the extractor cup 94*a*. Here, the extractor cup 94*a* has no bottom, but one or two conductive metal strips are inserted into the extractor to make contact between the external coaxial lead 90 and the extractor wall, providing the needed electrical connection. A single strip is shown at 100 in FIGS. 12 and 12A, and a pair of opposed such connector strips are shown at 100 and 102 in FIG. 12B. Contact can be made by a tight fit or with brazing.

Figure 13A:
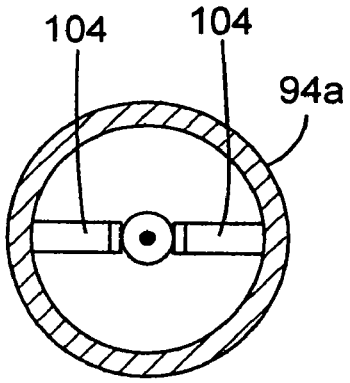
FIG. 13A is sectional view illustrating the arrangement of FIG. 13.
Figure 13:
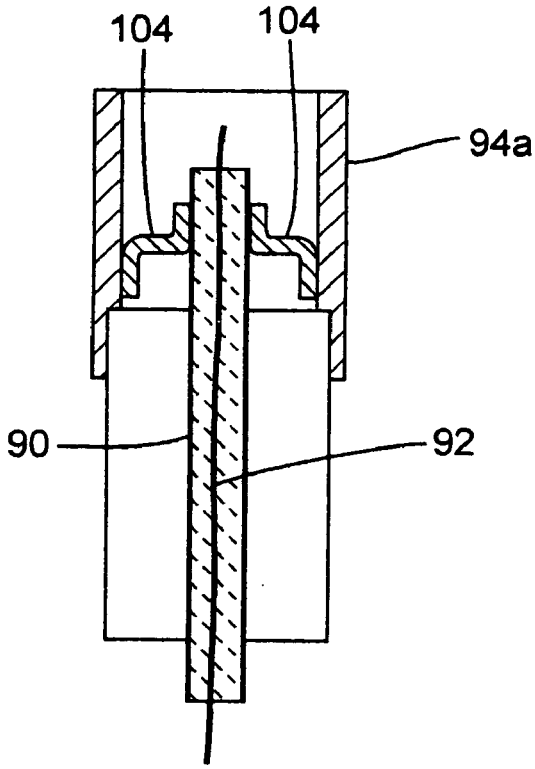
FIG. 13 is another view similar to FIG. 11, but showing a further connection arrangement, in this case including spring clips as conductors.

FIG. 13 shows spring clips 104 extending radially from the coaxial cable 90, 92 into contact with the wall of the extractor 94*a*. In addition to providing electrical connection between the outer conductor 90 and the extractor 94*a*, the clips also hold the coaxial connector 90, 92 in place within the extractor. FIG. 13A shows this assembly in plan section.

Figure 14A:
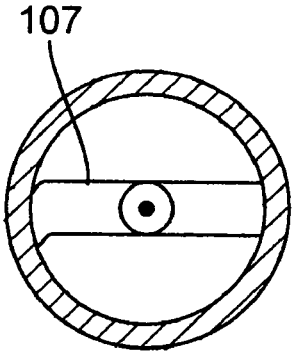
FIGS. 14 and 14A are sectional views showing further connection arrangements involving wires, for a cathode assembly having a coaxial lead generally as in FIG. 11.
Figure 14:
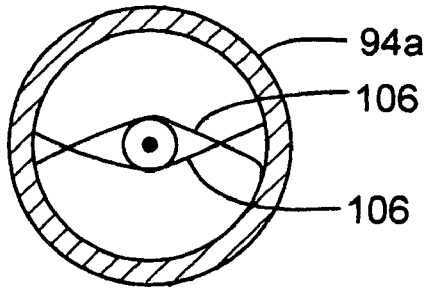

FIGS. 14 and 14A show in plan section the use of a pair of wires to connect the outer coaxial lead 90 to the extractor 94*a*. In FIG. 14 the wires 106 are shown crossing over one another, whereas in FIG. 14A wires 107 are shown running parallel. In both cases the wires are both in contact with the outer coaxial conductor. The wires can be attached to the extractor cup by spot welding or other techniques. The distance between the wires, undeflected, is closer than the outside diameter of the coaxial cable. Electrical contact can be provided by twisting the wires (FIG. 14), which are somewhat springy, and sliding the coaxial cable, i.e. the outer conductor 90, between them. The distance between the two wires, in both FIGS. 14 and 14A, is smaller than the outer diameter of the coaxial cable to provide a tight fit and good contact.

Figure 15:
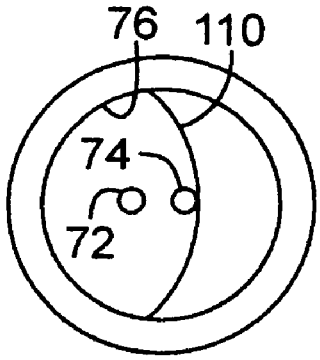
FIG. 15 is a simplified schematic cross-sectional view through an extractor cup and cathode assembly, showing the use of a spring clip or spring wire as a connecting conductor, with a dual-filament post assembly.
Figure 16:
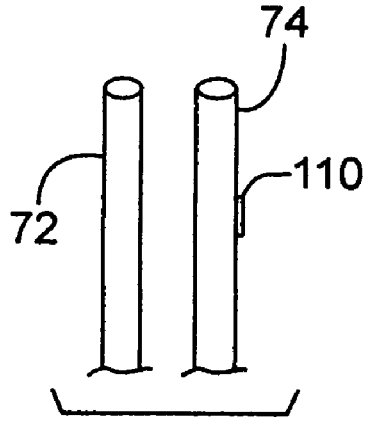
FIG. 16 is a schematic view in elevation showing the dual filament posts and the spring clip of FIG. 15.

FIGS. 15 and 16 show an arrangement similar to FIG. 14, with a spring wire or spring strip 110 providing a conductive path between a filament support lead post 74 and an extractor 76. In this case a single wire 110 is used, and the filament leads are not coaxial as in FIG. 14. The springy strip or sheet of foil or whisker 110 can be spot welded to the filament post 74, and in constant spring compression against the wall of the extractor cup 76. The spring material can be one of the nickel alloys such as Hastalloy or Kovar that can be welded and remains springy at 300° to 400° C. Tungsten, Molybdenum stainless steel can also used. The strip can take the form of a foil or wire as well as the flat strip 110 shown in FIG. 16.

Figure 17:
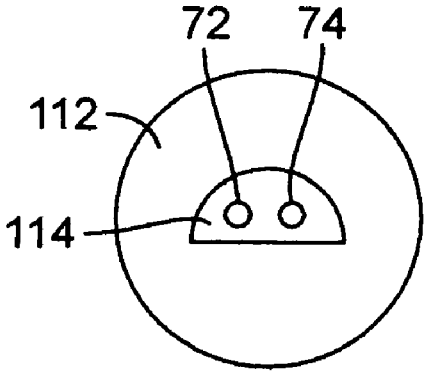
FIGS. 17, 18, and 19 are schematic sectional and sectional elevation views showing another connection scheme involving rotation of a conductive member to make the needed electrical contact after initial assembly and prior to final firing.
Figure 18:
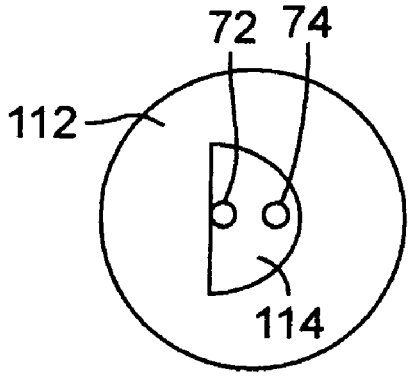
Figure 19:
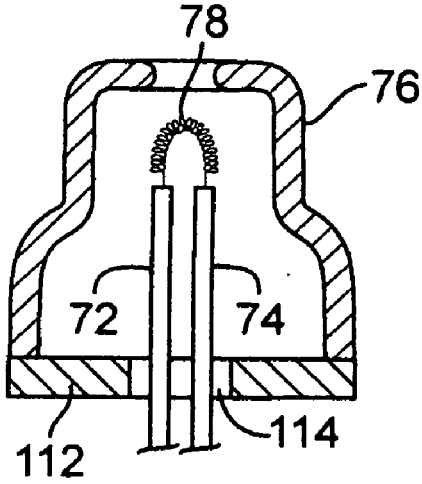

FIGS. 17–19 show a further embodiment of a connection scheme. In this arrangement a plate 112 is included on the bottom of an extractor cup 76 as shown schematically in FIG. 19. The plate has an oblong hole 114 through which the filament leads 72, 74 are extended, these leads supporting a filament 78. FIG. 17 shows that the opening 114 can be generally D-shaped, with the long edge of the D lying parallel to the two posts 72 and 74 upon initial assembly. The opening 114 could be oval, elliptical, other oblong shapes or even circular, as long as it is non-symmetrically positioned about the two leads 72, 74. Once the filament and posts have been inserted into the extractor cup through the hole 114, the extractor cup and bottom plate 112 are rotated, about 90° or sufficiently to firmly place a wall of the plate opening 114 into engagement with one lead 72 of the cathode assembly. The extractor cup is glassed or brazed into position after proper assembly. The extractor could be already in place, glassed to the frame, and the filament assembly rotated to make contact. In this case the filament assembly would be heated to seal it into the frame and fix the relationship with the extractor cup.

FIG. 20 and FIG. 21 show a simple mechanical connection for placing high voltage potential at the extractor cup. In the schematic view of FIG. 20, the inner wall 120 of an extractor cup is indicated, along with two filament support posts or pins 122 and 124. As discussed above, the cathode filament 126 is crimped to the top ends of these two conductive metal posts or pins in several embodiments, to secure and electrically connect the filament to the posts. During the attachment of the filament to the posts, which may be Kovar, a crimping tool is used. The crimp plastically deforms the Kovar around the filament wire. In this arrangement shown in FIG. 20, a non-symmetric crimp is used on the pin 126, in order to form an oblong shape that will contact the inner wall 120 of the extractor cup. The shape of this deformation can be set by the geometry of the crimping tool 128 as shown in FIG. 21. The crimping tool jaws can be machined non-symmetrically at 130, to form the elongated, oblong crimp. A standard crimp forming cavity 132 can also be included on the tool, to form the crimp at 122 in FIG. 20. As an alternative to this method, an upset can be put in one of the posts to cause contact between the post and the cup.

FIG. 22 shows a variation wherein the extractor cup 24 is connected not to the cathode filament 22 or either end of the filament, but to a third conductor 140. This third conductor 140, also at high voltage and electrically isolated from the two HV filament leads 18 and 20, allows the extractor to be electrically biased with respect to either of the HV leads 18, 20 independently. This permits a level of electronic control of the availability of electrons to the anode (electronic gain control). As seen in FIG. 22, one arrangement for connecting this third HV conductor 140 to the extractor 24 is similar to what is shown in FIG. 2; the conductor wire 140 is positioned over the edge of the insulative base 16 such that the metal extractor cup 24 will crimp or deform the wire 140 as the cup is assembled onto the base 16, thus making a good electrical contact.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. In a miniature x-ray tube having a cathode with a cathode filament, an anode and an extractor cup adjacent to the cathode, a means of connecting high voltage potential to the extractor cup, comprising:

the cathode filament being supported on posts from a non-conductive cathode base, the posts being conductive and extending into the interior of the extractor cup, the extractor cup comprising a hollow shape with conductive material at least on an inner surface of the extractor cup, and the extractor cup being secured to the base during assembly of the x-ray tube, a wire extending from one end of the cathode filament and into electrical contact with a wall of the extractor cup.

2. The x-ray tub of claim 1, wherein the wire has a braze alloy coated on its end, which has been melted during heating of the cathode to firmly secure the end of the wire to the extractor wall.

3. The x-ray tube of claim 1, wherein the end of the wire lies against the cathode base and over a peripheral edge of the cathode base, and wherein the extractor cup has a bottom end with an inside diameter slightly larger than an outside diameter of the cathode base, the extractor cup being assembled down over the periphery of the cathode base and pinching the end of the wire between the cathode base and the inside diameter of the extractor cup at its bottom end, thereby making electrical connection between the wire and the inner surface of the extractor cup.

4. The x-ray tube of claim 3, wherein the cathode base comprises a heated and cured preform glass, fixed to the extractor cup and firmly retaining the wire end after assembly and heat curing.

5. The x-ray tube of claim 1, wherein the wire extending from a filament end comprises an extending tail of the filament itself, the filament being fixed to both posts and continuing from one of the posts to a contact with the inner surface of the extractor cup.

6. The x-ray tube of claim 1, wherein the wire comprises a discrete wire different from the filament, the filament support posts having hollow upper ends and the wire being co-crimped into the upper end of one of the posts along with an end of the filament.

7. In a miniature x-ray tube having a cathode with a cathode filament, an anode and an extractor cup adjacent to the cathode, a means of connecting high voltage potential to the extractor cup, comprising:

a filament support post as a first conductive filament lead extending into the interior of the extractor cup and supporting one end of the cathode filament, the extractor cup comprising a hollow shape with conductive material at least on an inner surface of the extractor cup, and the extractor cup being secured to the base during assembly of the x-ray tube, the cathode filament having a second end opposite said one end, the second end being secured to the inner surface of the extractor cup, and a second conductive lead extending from the cathode base and being connected with the inner surface of the extractor cup.

8. The x-ray tube of claim 7, wherein the inner surface of the extractor cup has a recess or hole within which the second end of the filament is received.

9. The x-ray tube of claim 7, wherein the second end of the filament is secured to the extractor cup by brazing.

10. The x-ray tube of claim 7, wherein the filament support post comprises a sole filament support post, the second conductive lead being connected directly to the extractor cup.

11. The x-ray tube of claim 7, wherein the second conductive lead comprises a second filament support post and supports the filament near said second end.

* * * * *